US008468782B2

(12) United States Patent
Michalsky et al.

(10) Patent No.: US 8,468,782 B2
(45) Date of Patent: Jun. 25, 2013

(54) METHOD FOR PRODUCING A BOTTLE-LIKE OR TUBULAR CONTAINER, PARTICULARLY A TUBULAR BAG, COMPRISING A SEALED-IN BOTTOM, AND A CORRESPONDINGLY PRODUCED TUBULAR BAG

(75) Inventors: Andreas Michalsky, Memmingerberg (DE); Jürgen Pfrommer, Straubenhardt (DE)

(73) Assignee: Herrmann Ultraschalltechnik GmbH & Co. KG, Karlsbad (DE)

( * ) Notice: Subject to any disclaimer, the term of this patent is extended or adjusted under 35 U.S.C. 154(b) by 1067 days.

(21) Appl. No.: 11/667,202

(22) PCT Filed: Nov. 3, 2005

(86) PCT No.: PCT/EP2005/011772

§ 371 (c)(1),
(2), (4) Date: Feb. 29, 2008

(87) PCT Pub. No.: WO2006/048286

PCT Pub. Date: May 11, 2006

(65) Prior Publication Data

US 2008/0290100 A1 Nov. 27, 2008

(30) Foreign Application Priority Data

Nov. 4, 2004 (DE) ..... 10 2004 053 299
Feb. 15, 2005 (DE) ..... 10 2005 006 827

(51) Int. Cl.
*B65B 43/00* (2006.01)

(52) U.S. Cl.
USPC ..... 53/452; 53/456; 493/296; 493/308; 220/694; 156/229

(58) Field of Classification Search
USPC ..... 53/452, 456, 459; 493/296, 297, 493/308; 222/107; 220/694; 156/229
See application file for complete search history.

(56) References Cited

U.S. PATENT DOCUMENTS 182,905 A 10/1876 Drummond
360,993 A 4/1887 Brown (Continued)

FOREIGN PATENT DOCUMENTS

AT 293944 10/1971
CA 2342504 A1 10/2001

(Continued)

OTHER PUBLICATIONS

Allcock, Harry R., "Contemporary Polymer Chemistry"—1990, Prentice Hall, second edition, p. 34, 1990.

(Continued)

*Primary Examiner* — Thanh Truong
(74) *Attorney, Agent, or Firm* — Knobbe, Martens, Olson & Bear, LLP

(57) ABSTRACT

The invention relates to a method of producing a bottle-like or tube-like container, especially a tubular pouch (10), having a tubular pouch body (20) and a sealed-in end (30), such as, for example, a base, especially a stand-up base, and optionally a sealed-in top part and/or shoulder part, wherein at least the base (30) and, where applicable, the top part and/or the shoulder part is introduced into the tubular pouch body (20), the tubular pouch body (20) being stretched, especially expanded, at least in the region of introduction, by a predetermined amount before and/or during introduction of the base (30) and, where applicable, of the top part and/or the shoulder part. The invention relates also to a tubular pouch so produced.

21 Claims, 4 Drawing Sheets

U.S. PATENT DOCUMENTS 1,434,460 A 11/1922 Tibbatts
2,084,973 A 6/1937 John
2,348,696 A 5/1944 Schabacker
2,370,226 A 2/1945 Brede
2,373,340 A 4/1945 Rohdin
2,384,324 A 9/1945 Martin
2,401,231 A 5/1946 Crawford
2,440,339 A 4/1948 Langer
2,490,978 A 12/1949 Osterheld
2,626,647 A 1/1953 Barton
2,824,010 A 2/1958 Pedersen
2,847,151 A 8/1958 Meyer-Jagenberh
2,965,256 A 12/1960 Yochem
3,101,870 A 8/1963 Betner
3,128,913 A 4/1964 Specketer
3,217,951 A 11/1965 Paal
3,291,377 A 12/1966 Eggen
3,313,333 A 4/1967 Lordi
3,317,110 A 5/1967 Palmer
3,396,899 A 8/1968 Strouse et al.
D214,023 S 5/1969 Beaumont
3,519,158 A 7/1970 Anderson
3,548,564 A 12/1970 Bruce et al.
3,604,491 A 9/1971 Spiess
3,608,709 A 9/1971 Pike et al.
3,662,913 A 5/1972 Mascia
3,690,524 A 9/1972 Haberhauer
3,734,393 A 5/1973 Stump
3,832,964 A 9/1974 Rockefeller
3,935,993 A 2/1976 Doyen et al.
3,937,396 A 2/1976 Schieder
3,973,719 A 8/1976 Johnson et al.
3,997,677 A 12/1976 Hirsch et al.
4,022,373 A 5/1977 Kohnlein et al.
4,091,929 A 5/1978 Krane et al.
4,108,330 A 8/1978 Patterson
4,116,359 A 9/1978 Josephy
4,132,331 A 1/1979 Magerle
4,194,641 A 3/1980 Gaiser
4,201,306 A 5/1980 Dubois et al.
4,210,674 A 7/1980 Mitchell
4,216,268 A 8/1980 Stillman
4,235,349 A 11/1980 Uhlig
4,241,130 A 12/1980 Barnes
4,252,238 A 2/1981 Spiegelberg
4,262,819 A 4/1981 Hayes
4,264,007 A 4/1981 Hunt
4,267,939 A 5/1981 Perrett et al.
4,304,038 A 12/1981 Yabu et al.
4,310,162 A 1/1982 Donovan
4,328,905 A 5/1982 Hardt
4,337,862 A 7/1982 Suter et al.
4,353,497 A 10/1982 Bustin
4,428,477 A 1/1984 Cristofolo
4,471,882 A 9/1984 Joo
4,476,987 A 10/1984 Nolan
4,519,859 A 5/1985 Roth et al.
4,526,287 A 7/1985 Miyamatsu et al.
4,541,546 A 9/1985 Imazu et al.
4,568,001 A 2/1986 Sander
4,572,377 A 2/1986 Beckett
4,606,462 A 8/1986 Bogren et al.
4,659,408 A 4/1987 Redding
4,697,719 A 10/1987 Allen
4,709,397 A 11/1987 Voshall et al.
4,775,098 A 10/1988 Peer, Jr.
4,779,998 A 10/1988 Wischusen, III
4,787,511 A 11/1988 McIver
4,792,061 A 12/1988 Nishida
4,834,247 A 5/1989 Oshima et al.
4,890,744 A 1/1990 Lane, Jr. et al.
4,890,759 A 1/1990 Scanga et al.
4,923,702 A 5/1990 Powell et al.
D311,488 S 10/1990 Regenscheid
4,961,513 A 10/1990 Gossedge et al.
4,978,015 A 12/1990 Walker
4,982,872 A 1/1991 Avery
4,983,431 A 1/1991 Gibbons et al.
4,986,053 A 1/1991 Schaefer
4,997,661 A 3/1991 Kromer
5,009,364 A 4/1991 Bolte
5,024,044 A 6/1991 Friedrich et al.
5,041,180 A 8/1991 Makilaakso
5,098,794 A 3/1992 Schaefer
5,114,766 A 5/1992 Jacques
5,184,771 A 2/1993 Jud et al.
5,205,651 A 4/1993 Decottignies et al.
5,217,164 A 6/1993 Sullivan et al.
5,240,130 A 8/1993 Osbakk
5,261,990 A 11/1993 Galda et al.
5,263,606 A 11/1993 Dutt et al.
5,284,540 A 2/1994 Roth et al.
5,350,240 A 9/1994 Billman et al.
5,409,115 A 4/1995 Barkhorn
5,460,838 A 10/1995 Wermund
5,493,844 A 2/1996 Combrink
5,587,192 A 12/1996 Beizermann
5,622,432 A 4/1997 Zicker
5,647,500 A 7/1997 Konno et al.
5,669,521 A 9/1997 Wiening et al.
5,733,652 A 3/1998 Stowman et al.
5,823,383 A 10/1998 Hins
5,885,635 A 3/1999 Spring et al.
5,885,673 A 3/1999 Light et al.
5,913,449 A 6/1999 Branch et al.
5,939,153 A 8/1999 Valyi
5,945,145 A 8/1999 Narsutis et al.
6,000,848 A 12/1999 Massioui
6,004,638 A 12/1999 Kaya et al.
6,050,451 A 4/2000 Hess, III et al.
6,076,664 A 6/2000 Yeager et al.
6,123,211 A 9/2000 Rashid et al.
6,199,698 B1 3/2001 Hetrick et al.
6,220,310 B1 4/2001 Emmer
6,226,964 B1 5/2001 Vettorato
6,231,237 B1 5/2001 Geller
6,261,215 B1 7/2001 Imer
6,270,867 B1 8/2001 Eckstein et al.
6,276,546 B1 8/2001 Davis et al.
6,279,297 B1 8/2001 Latronico
6,287,658 B1 9/2001 Cosentino et al.
6,334,710 B1 1/2002 Kuge et al.
6,399,014 B1 6/2002 Hermodsson
6,436,497 B1 8/2002 Takahashi et al.
6,436,499 B1 8/2002 Krampe et al.
6,478,190 B2 11/2002 Kuge et al.
D476,565 S 7/2003 Rosen
6,655,114 B2 12/2003 Hiramoto et al.
6,668,517 B2 12/2003 Hiramoto et al.
6,681,950 B2 1/2004 Miller, Jr. et al.
6,745,540 B2 6/2004 Hiramoto et al.
6,751,928 B2 6/2004 Hiramoto et al.
6,783,277 B2 8/2004 Edwards et al.
6,929,400 B2 8/2005 Razeti et al.
6,938,805 B2 9/2005 Brincat
D510,277 S 10/2005 Bennie et al.
7,034,268 B2 4/2006 Hopkins, Sr. et al.
7,105,788 B2 9/2006 Hopkins
7,115,309 B2 10/2006 Akiyama et al.
7,364,047 B2 4/2008 Michalsky
7,444,795 B2 11/2008 Yasuhira
7,543,990 B2 6/2009 Michalsky
7,743,962 B2 6/2010 Le Cocq et al.
8,056,209 B2 11/2011 Michalsky
2001/0042757 A1 11/2001 Kuge et al.
2002/0112982 A1 8/2002 Stagray et al.
2002/0125249 A1 9/2002 Baird-Smith et al.
2002/0162863 A1 11/2002 Brincat
2002/0182351 A1 12/2002 Akiyama et al.
2003/0038170 A1 2/2003 Case
2003/0059130 A1 3/2003 Youneyama et al.
2003/0077010 A1 4/2003 Schulz
2003/0144122 A1 7/2003 Post et al.
2003/0173363 A1 9/2003 Miller, Jr. et al.
2004/0026432 A1* 2/2004 Matsumura et al. ..... 220/600
2004/0052987 A1 3/2004 Shetty et al.
2004/0226990 A1 11/2004 Williams et al.

| | | | |
|---|---|---|---|
| 2004/0238475 | A1 | 12/2004 | Peronek |
| 2005/0041888 | A1 | 2/2005 | Matsuzawa et al. |
| 2005/0252811 | A1 | 11/2005 | Perbet |
| 2005/0265636 | A1 | 12/2005 | Michalsky |
| 2005/0271306 | A1 | 12/2005 | Murray |
| 2006/0201903 | A1 | 9/2006 | Peronek |
| 2007/0261758 | A1 | 11/2007 | Hoover |
| 2008/0184548 | A1 | 8/2008 | Michalsky |
| 2009/0041394 | A1 | 2/2009 | Michalsky |
| 2009/0308023 | A1 | 12/2009 | Wada |
| 2011/0233926 | A1 | 9/2011 | Carcagno |
| 2011/0278298 | A1 | 11/2011 | Zaggia |

FOREIGN PATENT DOCUMENTS

| | | | |
|---|---|---|---|
| CH | 669 563 | A5 | 3/1989 |
| DE | 1723470 | | 5/1956 |
| DE | 1 733 277 | | 10/1956 |
| DE | 1 757 066 | | 11/1957 |
| DE | 8810 166 | U1 | 5/1969 |
| DE | 2 000 532 | A1 | 7/1971 |
| DE | 2100833 | | 7/1971 |
| DE | 31 06 692 | A1 | 9/1972 |
| DE | 25 26 975 | A1 | 12/1976 |
| DE | 2644209 | A1 | 5/1977 |
| DE | 25 56 230 | A1 | 7/1977 |
| DE | 3208625 | A1 | 10/1982 |
| DE | 33 29 533 | A1 | 3/1985 |
| DE | 37 09 867 | C2 | 3/1987 |
| DE | 2904847 | | 8/1990 |
| DE | 3904847 | A1 | 8/1990 |
| DE | 91 07 722.2 | | 8/1991 |
| DE | 4023602 | A1 | 1/1992 |
| DE | 3877718 | T2 | 5/1993 |
| DE | 43 038 94 | A1 | 8/1994 |
| DE | 4429148 | A1 | 2/1996 |
| DE | 19581417 | | 4/1996 |
| DE | 19548173 | A1 | 6/1997 |
| DE | 1 786 019 | | 11/1997 |
| DE | 298 00 794 | | 4/1998 |
| DE | 69407954 | T2 | 6/1998 |
| DE | 198 28 178 | | 9/1999 |
| DE | 299 20 874 | U1 | 2/2000 |
| DE | 198 60 473 | A1 | 6/2000 |
| DE | 202 12 251 | U1 | 1/2003 |
| DE | 20214197 | | 1/2003 |
| DE | 10238965 | | 8/2003 |
| DE | 10238965 | A1 | 8/2003 |
| DE | 203 12 111 | U1 | 12/2003 |
| DE | 10221432 | | 12/2003 |
| DE | 202 15 255 | U1 | 2/2004 |
| DE | 10257145 | | 6/2004 |
| DE | 102004023023 | A1 | 12/2005 |
| DE | 102004042968 | A1 | 3/2006 |
| EP | 0 078 761 | | 5/1983 |
| EP | 0 153 987 | A | 9/1985 |
| EP | 0153987 | A2 | 9/1985 |
| EP | 0 182 416 | A | 5/1986 |
| EP | 0 203 612 | A2 | 5/1986 |
| EP | 0321172 | A2 | 6/1989 |
| EP | 0 324 260 | | 7/1989 |
| EP | 0 333 443 | | 9/1989 |
| EP | 0 360 737 | A | 3/1990 |
| EP | 0 379 136 | | 7/1990 |
| EP | 0 446 005 | | 9/1991 |
| EP | 0 521 642 | A | 1/1993 |
| EP | 0 537 109 | A2 | 4/1993 |
| EP | 0595587 | B1 | 5/1994 |
| EP | 0684184 | | 11/1995 |
| EP | 0 772 522 | | 5/1997 |
| EP | 0 785 148 | A | 7/1997 |
| EP | 0833774 | B1 | 4/1998 |
| EP | 0976539 | | 2/2000 |
| EP | 0 661 219 | B1 | 3/2000 |
| EP | 1 029 794 | A | 8/2000 |
| EP | 1 086 906 | A | 3/2001 |
| EP | 1106516 | | 6/2001 |
| EP | 1151934 | | 11/2001 |
| EP | 1151934 | A1 | 11/2001 |
| EP | 1174360 | | 1/2002 |
| EP | 1064150 | B1 | 10/2002 |
| EP | 1331174 | | 7/2003 |
| EP | 1 362 797 | A2 | 11/2003 |
| EP | 1362797 | A | 11/2003 |
| EP | 1362797 | A2 | 11/2003 |
| EP | 10 042 187 | | 1/2005 |
| EP | 1 508 531 | A | 2/2005 |
| EP | 1512637 | | 3/2005 |
| EP | 1621477 | | 2/2006 |
| EP | 1657174 | A1 | 5/2006 |
| FI | 109193 | B | 2/2000 |
| FR | 2 487 805 | A | 2/1982 |
| FR | 2 577 897 | A | 8/1986 |
| FR | 2 729 366 | | 7/1995 |
| FR | 2771720 | A1 | 6/1999 |
| FR | 2 859 182 | A | 3/2005 |
| GB | 1 298 790 | A | 12/1972 |
| GB | 2 254 594 | A | 10/1992 |
| GB | 2257943 | A | 1/1993 |
| GB | 2 188 520 | A | 9/1997 |
| JP | 10 152146 | A | 6/1998 |
| JP | 11-171203 | | 6/1999 |
| JP | 11-198289 | | 7/1999 |
| JP | 2000-006999 | | 1/2000 |
| JP | 2000-211675 | | 8/2000 |
| JP | 2001-080650 | | 3/2001 |
| JP | 2000 335630 | A | 4/2001 |
| JP | 2001-176461 | | 6/2001 |
| JP | 2001-176463 | | 6/2001 |
| JP | 2001-270534 | | 10/2001 |
| JP | 2002-104446 | | 4/2002 |
| JP | 2002-211588 | A | 7/2002 |
| JP | 2004-51125 | A | 2/2004 |
| JP | 2004-083085 | | 3/2004 |
| JP | 2004-255742 | A | 9/2004 |
| JP | 2005-025281 | | 1/2005 |
| JP | 2005-132398 | A | 5/2005 |
| KR | 10-0274821 | | 9/2000 |
| NL | 6 810 059 | A | 7/1969 |
| RU | 2139824 | C1 | 10/1999 |
| WO | WO 94/23945 | | 10/1994 |
| WO | WO 96/03281 | | 2/1996 |
| WO | WO 96/21599 | A | 7/1996 |
| WO | WO 98/02305 | A1 | 1/1998 |
| WO | WO 99/46120 | A1 | 9/1999 |
| WO | WO 99/64227 | | 12/1999 |
| WO | WO 00/00396 | | 1/2000 |
| WO | WO 0012387 | | 3/2000 |
| WO | WO 00/49908 | | 8/2000 |
| WO | WO 00/50314 | | 8/2000 |
| WO | WO 01/83212 | A | 11/2001 |
| WO | WO 02/055402 | | 7/2002 |
| WO | WO 02/055405 | | 7/2002 |
| WO | WO 03/018420 | A | 3/2003 |
| WO | WO03/097479 | | 11/2003 |
| WO | WO 2004/101374 | A | 11/2004 |
| WO | WO2005/105600 | | 11/2005 |
| WO | WO 2006/000820 | | 1/2006 |
| WO | WO 2007/042174 | A1 | 4/2007 |

OTHER PUBLICATIONS

English translation of Japanese Office Action in counterpart JP Application No. 2007-538363, dated Jun. 21, 2011, 4 pages.

German Search Report re DE Application No. 10 2009 007 860.6, dated Jan. 12, 2010.

Japanese Office Action re JP Application No. 2009-538648, dated Nov. 22, 2011.

Russian Office Action, re RU Application No. 2010114989/12(021159), dated Jun. 28, 2011.

Japanese Office Action re JP Application No. 2008-500079, dated Jan. 24, 2012.

* cited by examiner

METHOD FOR PRODUCING A BOTTLE-LIKE OR TUBULAR CONTAINER, PARTICULARLY A TUBULAR BAG, COMPRISING A SEALED-IN BOTTOM, AND A CORRESPONDINGLY PRODUCED TUBULAR BAG

PRIOR APPLICATION INFORMATION

This application is the U.S. National Phase of International Application No. PCT/EP2005/011772, filed Nov. 3, 2005, claiming priority to German Application No. 10 2004 053 299.0 filed on Nov. 4, 2004 and German Application No. 10 2005 006 827.8 filed Feb. 15, 2005.

The invention relates to a method of producing a bottle-like or tube-like container, especially a tubular pouch, having a tubular pouch body and a sealed-in base, especially a stand-up base, and optionally a sealed-in top part and/or shoulder part, and to such a tubular pouch in accordance with the preambles of patent claims 1, 17 and 18.

Tubular pouches having sealed-in base parts and optionally sealed-in top and/or shoulder parts are commonly used for filling with liquid, paste-form or solid goods. A problem with the previously known tubular pouches of that kind, however, is that they generally prove to have little stability. Furthermore, the sealing-in of the base and, where applicable, also of the top part and/or the shoulder part has proved problematic, because those parts have to be fitted exactly into the tubular pouch body, the insertion of the base and, where applicable, the top and/or shoulder part(s) into the tubular pouch body being difficult to perform and in some cases resulting in wrinkling or in non-uniform contact between the base, top and/or shoulder part(s) and the tubular pouch body and in associated inadequate sealing.

In order to avoid such problems, in the past the base and the corresponding head-side closure parts, that is to say the top and/or shoulder parts, to be sealed in were made slightly smaller than the tubular pouch body and optionally provided with a recess or a fold or crease and introduced in that form into the tubular pouch body. Such base and, where applicable, top and/or shoulder parts are problematic from sealing standpoints, however, because a gap remains at least in some regions between the base and, where applicable, the top part and/or the shoulder part and the tubular pouch body, which gap has to be filled with sealing medium in order to ensure that the tubular pouch is properly sealed; however, that increases the amount of sealing medium required.

The problem underlying the invention is to improve the problematic situation mentioned above to the effect that there is provided a method of producing a tubular pouch and a corresponding tubular pouch, which has a sealed-in base and optionally a sealed-in top part and/or shoulder part, wherein the base part and, where applicable, the top part and/or the shoulder part is sealable into the tubular pouch body economically using simple measures, provides the tubular pouch with a high degree of stability and good grip and with a high level of sealing, and has a low requirement for material, especially sealing medium.

That problem is solved by a method in accordance with patent claim 1 and by a tubular pouch in accordance with patent claims 17 and 18.

The problem is solved, in particular, by a method of producing a tubular pouch having a tubular pouch body and a sealed-in base, especially a stand-up base, and optionally a sealed-in top part and/or shoulder part, wherein at least the base and, where applicable, the top part and/or the shoulder part is introduced into the tubular pouch body, the tubular pouch body being stretched, especially expanded, at least in the region of introduction, by a predetermined amount before and/or during introduction of the base and, where applicable, of the top part and/or the shoulder part.

An important aspect of the invention is that it is in that way possible to use an exactly fitting base part, top part and/or shoulder part which is sealed into the tubular pouch body.

In accordance with one embodiment, the stretching or expanding of the tubular pouch body is carried out reversibly, so that the tubular pouch body, after introduction of the base part or top part and/or shoulder part, lies closely against that (those) part(s).

The amount of stretching or expanding of the tubular pouch body is in the range of from 100.5% to 112.0%, preferably in the range of from 101.0% to 107.8% and especially in the range of from 102.0% to 105.0%, relative to the tubular pouch diameter of an unstressed tubular pouch with normalisation to 100%.

The stretching or expanding of the tubular pouch body is advantageously carried out after the tubular pouch body has been produced from a preferably film-form tubular pouch material, especially laminate, or has been extruded in the form of a tube, preferably a seamless tube. The production of the tubular pouch body can be carried out with formation of a lap seal or fin seal, there being used a laminate that is sealable on one side or, preferably, both sides.

Advantageously, the material used for the base, top and/or shoulder part(s) to be sealed-in and in the sealing layer is the same as that used for the production of the tubular pouch body itself.

It should be mentioned at this point that the stretching of the laminate from which the tubular pouch body is formed can also be effected before the production of the tubular pouch body, that is to say in the case of a flat film in the form of sheet material.

In accordance with one embodiment of the invention, the tubular pouch body is stretched or expanded conically in the region of introduction of the base, top and/or shoulder part(s), the inner diameter of the tubular pouch body decreasing from the outside to the inside, that is to say in the direction of the pouch interior. The degree of taper of the stretching or expanding, relative to an unexpanded tubular pouch body, is in the range of from 1.5° to 17°, preferably in the range of from 5° to 14.5° and especially in the range of from 8.0° to 12°. The amount of stretching and the degree of taper of the stretching is governed by the material and the thickness of the tubular pouch body and base and its restoring force and by the desired shape of the base.

Furthermore, according to the invention the base and, where applicable, the top part and/or the shoulder part has a conical shape. It is accordingly advantageously readily possible on the one hand to introduce the base into the stretched tubular pouch body. It will be understood that the same is true of the top and/or the shoulder part, which are in turn simple to introduce into the stretched tubular pouch body by making use of their conical shape.

A further advantage of the conical shape of the base part is that it is thus possible to enlarge the standing surface of the tubular pouch, so that the stability of the tubular pouch can be increased in an extremely simple way.

The degree of taper of the base or base part and of the top part and/or the shoulder part is made slightly less than the degree of taper of the associated stretched or expanded tubular pouch body part. Exactly fitting introduction of the base into the tubular pouch body is accordingly possible without problems, the tubular pouch body lying in optimum manner against the base part by virtue of the restoring force inherent in the material of the tubular pouch body. The same applies to the top and/or shoulder part(s).

In accordance with an advantageous embodiment of the invention, once the base and, where applicable, the top part and/or the shoulder part have been introduced, a seal-forming seal is formed at the edge of the base, the top part and/or the shoulder part located on the inside relative to the tubular pouch body, or on the inner peripheral rim thereof, by means of which the internal volume of the tubular pouch is sealed with respect to the environment.

Furthermore, to improve the stability of the tubular pouch there is formed on the edge of the base located on the outside relative to the tubular pouch body, that is to say on the outer peripheral rim thereof, a support-forming seal preferably having a structures surface, especially a grooved or fluted surface.

Such a support-forming seal can also be provided in the region of the top and/or shoulder part(s). Here it serves for strengthening the tubular pouch body, so that the latter, especially when flexible top and/or shoulder parts are used, forms a stable shape and retains that shape with a certain strength. The structuring on the support-forming seal can be elongate, for example grooved or fluted, such structuring being formed either vertically or, preferably, substantially in the plane of the top or shoulder part, that is to say horizontally. It should be mentioned at this point that other forms of structuring, for example zig-zag or wave-like profiles, also lie within the scope of the invention.

In order to be able to increase machine output, the seal-forming and support-forming seal(s) are formed substantially simultaneously.

According to the invention, a cut edge of the base and, where applicable, of the top part and/or the shoulder part is arranged inside the tubular pouch body, especially forming a reinforced peripheral rim, the cut edge being folded inwards between the base, top and/or shoulder part and the tubular pouch body. The cut edge accordingly serves as a further reinforcement, especially of the base of the tubular pouch body. Advantageously, the cut edge is drawn in or folded into the tube and visually disappears in the overlap and, where applicable, in the supporting seam of the base part and the tubular pouch body, the flank of the base advantageously being as steep as possible.

The formation of the seal between the base, top and/or shoulder part(s) and the tubular pouch body itself is effected by means of ultrasound, heat transfer, induction and/or hot air, but other sealing methods, such as, for example, adhesive sealing, are encompassed by the invention.

The base, top and/or shoulder part(s) according to the invention have regularly shaped, especially polygonal, round or oval, shapes and are, as required, made of a flexible material or of a dimensionally stable material. Depending upon the desired later contents of the tubular pouch, both the tubular pouch body itself and the base, top and/or shoulder part(s) have a barrier layer. Such a layer can consist, for example, of $SiO_2$, EVOH or of a metal foil, but other commonly used barrier layer materials are also possible.

In accordance with an especially preferred embodiment, the sealing is carried out by means of ultrasound. In that variant, the part to be sealed in is held, especially by suction and/or electrostatically, and introduced into the tubular pouch body by means of a sonotrode, an anvil being arranged externally on the tubular pouch body.

The advantage of that sealing method is the possibility of exerting a uniform sealing pressure over the entire rounded portion of the tubular pouch body. Furthermore, one sealing operation can be used to create the sealing seam and the supporting seam simultaneously. It is also possible to use laminate that seals on both sides, the ultrasound facilitating optimum energy transmission into the sealing layer. If, as already mentioned, the part to be sealed in is held by the sonotrode, the sonotrode can also be used as a transport tool for the part being sealed in. Moreover, the ultrasound sealing is advantageously suitable also for sealing packaging that has already been filled, because the ultrasound can be targeted solely on the sealing region and sealing can be carried out through any product in the sealing seam. A further advantage is the speed at which ultrasound sealing can be performed, the machine output and the reliability of the seal being optimised.

In accordance with a further development of the invention, it is possible for both the base part and the top part and/or the shoulder part to be sealed simultaneously into a tubular pouch body or into a tubular pouch already filled with, for example, a solid or paste-form filling. It will be understood that this can also be effected in succession, that is to say one after another, with, for example, first the top and/or shoulder part(s) being sealed into the tubular pouch body, which is then filled, and, after filling, the associated base part being sealed in.

Furthermore, the problem of the invention is solved by a tubular pouch having a tubular pouch body and a sealed-in base, especially a stand-up base, and optionally a sealed-in top part and/or shoulder part, wherein at least the base and, where applicable, the top part and/or the shoulder part has been inserted into the tubular pouch, the tubular pouch having been produced by a method in accordance with the above description.

Moreover, the invention is solved by a tubular pouch having a tubular pouch body and a sealed-in base, especially a stand-up base, and optionally a sealed-in top part and/or shoulder part, wherein at least the base and, where applicable, the top part and/or the shoulder part has been inserted into the tubular pouch body, the tubular pouch having, at least on the base side, at least one seal-forming and support-forming seal. The tubular pouch is of conical construction, at least in the region of the seal-forming and support-forming seal, and, where applicable, in the region of the top part and/or the shoulder part. Furthermore, the support-forming seal has a structured surface, especially grooves, or fluting in smooth, zig-zag or wave-like profiling.

Furthermore, the cut edge of the base part and, where applicable, of the top part and/or the shoulder part is arranged inside the outer periphery of the tubular pouch body.

Further embodiments of the invention will be found in the subsidiary claims.

The invention is described below on the basis of an exemplary embodiment which is explained in greater detail with reference to the Figures.

FIG. 4 illustrates a tubular pouch body produced by means of lap-seal (4A) or fin-seal sealing (4B), respectively.

Figure 6:
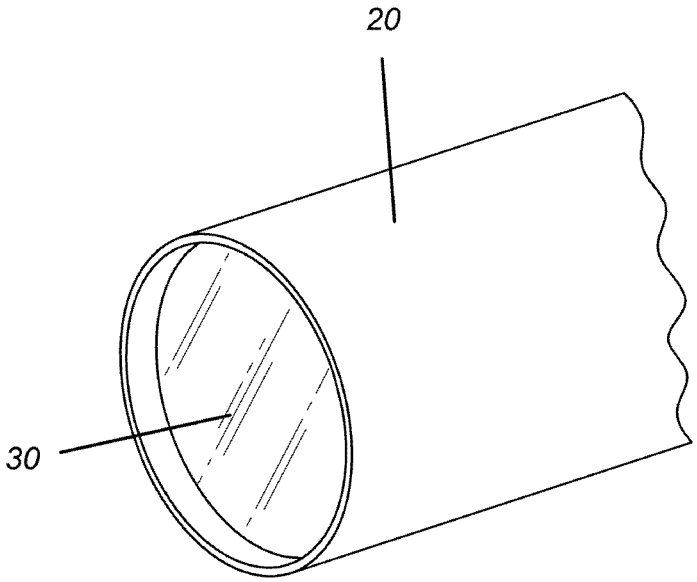
Figure 7:
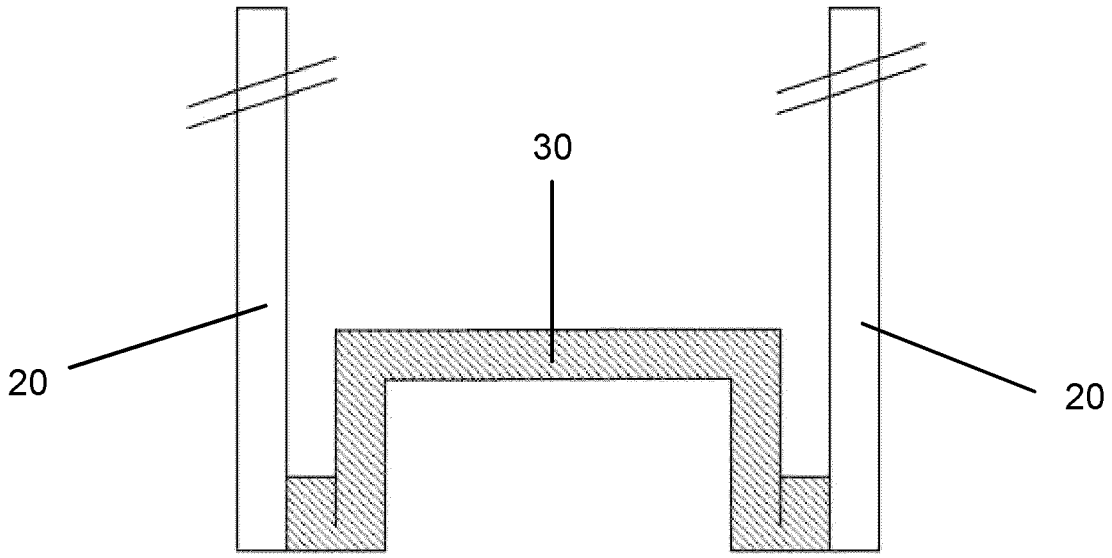

FIG. 6 shows some illustrative embodiments of the invention. More particularly, the base in this figure has a regularly shaped outline, especially a circular outline FIG. 7 shows some illustrative embodiments of the invention. More particularly, it illustrates an amendment where a base comprises an edge, said edge being arranged inside a body, and folded inwards between the base and the body so as to form a reinforced peripheral rim.

In the description which follows, parts that are the same or have the same action have been given the same reference numerals.

Figure 1:
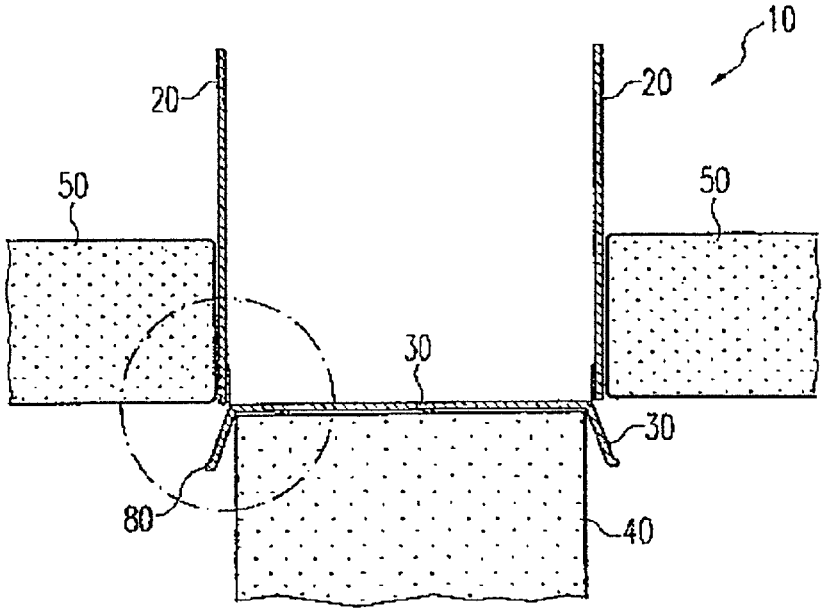
FIG. 1 is a diagrammatic view to illustrate the method according to the invention.
Figure 2:
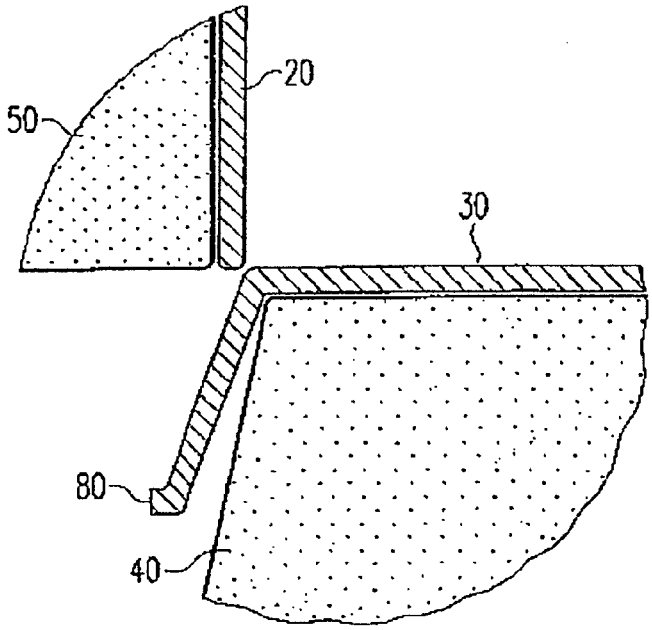
FIG. 2 shows a detail of the view according to FIG. 1.

FIG. 1 shows a diagrammatic view of the method according to the invention. It shows the lower portion of a tubular pouch 10 which is formed from a tubular pouch body 20 and a base 30. The base 30 is held by a sonotrode 40 and has on both sides cut edges 80 and a region that projects beyond the sonotrode and serves as the later seal region. The sectional view shown in FIG. 1 shows, at each side of the tubular pouch body 20, an anvil 50 extending around the tubular pouch body 20. The tubular pouch body 20 has been conically expanded in its lower portion by a factor of 1.028 (≙102.8%) with respect to an original unstressed 100% tubular pouch body and has at its lower end an internal diameter of 51.3 mm in order to facilitate the introduction of the base which has an outer diameter of the base upper edge of 49.9 mm. The tubular pouch body is of conical shape with an angle of 10°. The base to be sealed in lies on a sonotrode 40 of predetermined shape having a degree of taper of 5°, so that on introduction into the tubular pouch body the side flank of the base 30 is matched to the degree of taper of the tubular pouch body 20. The base held by the sonotrode 40 together with its left side flank and the cut edge 80 can be seen especially well in FIG. 2. FIG. 2 shows an enlarged view of the circled portion from FIG. 1. For the production of the tubular pouch 10, the sonotrode 40, with the base 30 lying thereon, is pushed into the conically expanded tubular pouch body 20 so that the cut edge 80 is also barely inside the tube. The cut edge 80 is then either also introduced into the tubular pouch body 20 or is folded over or turned back so that it comes to lie between the lower rim of the tubular pouch body 20 and the base 30.

Figure 3:
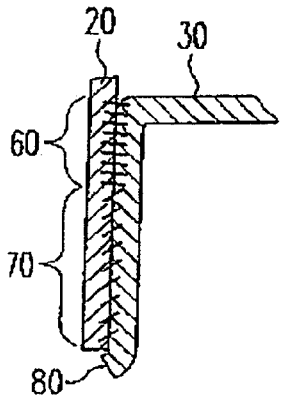
FIG. 3 is a diagrammatic view of a seal according to the invention.
Figure 4A:
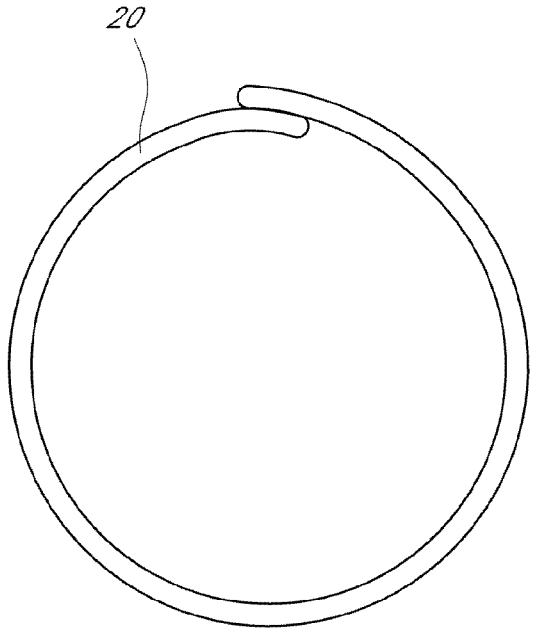
FIGS. 4A and 4B show some illustrative embodiments of the invention.
Figure 4B:
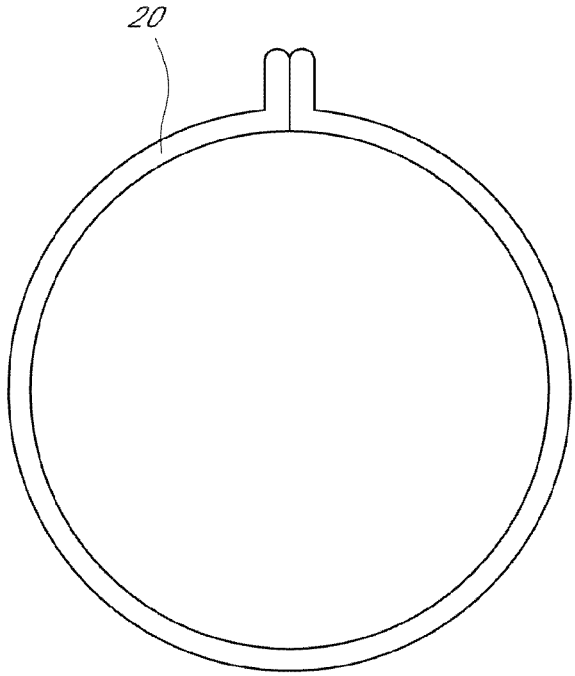
Figure 5:
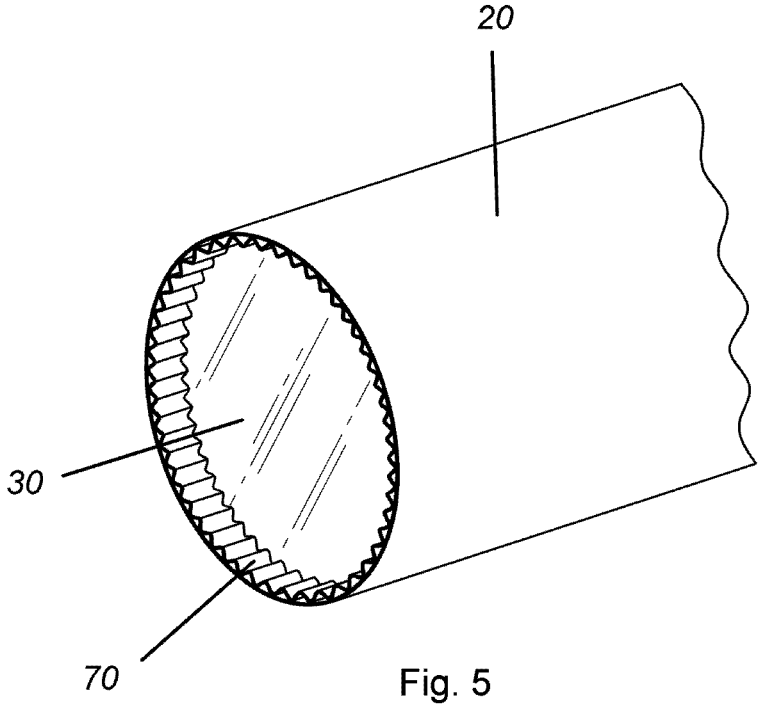
FIG. 5 shows some illustrative embodiments of the invention. More particularly, the support-forming seal in this figure has a structured surface, especially a grooved surface.

FIG. 3 is a detailed view of a base seal region, showing diagrammatically a seal-forming seal 60 and a support-forming seal 70 which join the tubular pouch body in a sealing and supporting way, respectively, to the base 30. On the upper edge of the base 30 there is a formed a 1 mm wide seal-forming seal. Shown below the seal-forming seal 60 there is a support-forming seal which is about 3 mm high. The cut edge 80 can be folded over before the support-forming seal is formed and drawn into the tube (not shown) and is able to disappear up to an extent of about 0.5 mm in the overlap between the tubular pouch body 20 and the base 30.

It should be pointed out here that all the above-described parts, considered alone and in any combination, especially the details shown in the drawings, are claimed as being important to the invention. Modifications thereof will be known to the person skilled in the art.

LIST OF REFERENCE NUMERALS

10 tubular pouch
20 tubular pouch body
30 base
40 sonotrode
50 anvil
60 seal-forming seal
70 support-forming seal
80 cut edge

The invention claimed is:

1. A method of producing a container, the container comprising:

a body having walls defining interior of the container; and a base sealed to the body;

the method comprising:

introducing the base into the body, the body being stretched or expanded, at least in a region of introduction, by a predetermined amount before and/or during introduction of the base;

wherein the base comprises an edge, said edge being arranged inside the body, and folded inwards between the base and the body so as to form a reinforced peripheral rim;

wherein a support-forming seal is formed between the body and a peripheral rim of the base;

wherein the support-forming seal comprises a structured surface, and the structured surface comprises a grooved or fluted surface; and wherein a degree of taper of the stretched or expanded region of the body relative to an unstretched or unexpanded body is in a range of 5° to 14.4°.

2. The method according to claim 1, wherein the stretching or expanding of the body to receive the base is carried out reversibly.

3. The method according to claim 1, wherein an amount of stretching or expanding is in the range of from 100.5% to 112.0%, relative to a diameter of an unstressed body.

4. The method according to claim 1, wherein the body, prior to the stretching or expanding, is produced by lap-seal or fin-seal sealing from a film-form material, or is extruded, in a form of a tube.

5. The method according to claim 1, wherein the stretching or expanding is carried out conically.

6. The method according to claim 1, wherein the degree of taper of the stretched or expanded region of the body relative to an unstretched or unexpanded body is in the range of 8° to 12.0°.

7. The method according to claim 1, wherein the base comprises a conically shaped peripheral rim.

8. The method according to claim 7, wherein the degree of taper of the peripheral rim of the base is slightly less than a degree of taper of the stretched or expanded region of the body.

9. The method according to claim 1, wherein the base is joined to the body to form a seal-forming seal.

10. The method according to claim 9, wherein the base is joined to the pouch body to form a seal-forming seal along an inner peripheral rim of the base.

11. The method according to claim 1, wherein the container further comprises a seal-forming seal, and the seal-forming and support-forming seals are formed substantially simultaneously.

12. The method according to claim 11, wherein the seal-forming and/or support-forming seal is effected by ultrasound, heat transfer, induction and/or hot air.

13. The method according to claim 12, wherein the base is held by suction and/or electrostatically, and introduced into the body by means of a sonotrode when ultrasound sealing is used.

14. The method according to claim 1, wherein the base has a regularly shaped outline.

15. The method according to claim 14, wherein said regularly shaped outline is a polygonal, circular or oval outline.

16. The method according to claim 1, wherein the base is sealed to the body in succession, after the tubular pouch has been filled.

17. The method according to claim 1, wherein the container is a bottle-shaped or tube-shaped container.

18. The method according to claim 17, wherein the container is a tubular pouch.

19. The method according to claim 1, wherein the sealed-in base is a stand-up base.

20. The method according to claim 4, wherein the film-form material is laminate.

21. The method according to claim 4, wherein the body is extruded seamlessly.

* * * * *